United States Patent [19]

Teruyama

[11] 4,090,820

[45] May 23, 1978

[54] GEAR PUMP WITH LOW PRESSURE SHAFT LUBRICATION

[75] Inventor: Hideo Teruyama, Ageo, Japan

[73] Assignee: Kayabakogyokabushikikaisha, Tokyo, Japan

[21] Appl. No.: 699,167

[22] Filed: Jun. 23, 1976

[30] Foreign Application Priority Data

Jun. 24, 1975 Japan ..... 50-77594
Oct. 11, 1975 Japan ..... 50-138864[U]

[51] Int. Cl.[2] ..... F01C 19/08; F01C 21/04; F01C 21/02; F01C 1/18

[52] U.S. Cl. ..... 418/1; 418/79; 418/102; 418/132

[58] Field of Search ..... 418/75, 79, 80, 102, 418/131, 132, 1

[56] References Cited

U.S. PATENT DOCUMENTS

| | | | |
|---|---|---|---|
| 2,891,483 | 6/1959 | Murray et al. | 418/102 |
| 3,447,472 | 6/1969 | Hodges et al. | 418/102 |
| 3,490,382 | 1/1970 | Joyner | 418/102 |

FOREIGN PATENT DOCUMENTS

| | | | |
|---|---|---|---|
| 1,386,237 | 3/1975 | United Kingdom | 418/102 |

*Primary Examiner*—John J. Vrablik
*Attorney, Agent, or Firm*—Saul Jecies

[57] ABSTRACT

A gear pump is disclosed wherein the shafts of at least a pair of intermeshing gears are rotatably supported in bushings each with an axially extended lubrication groove formed in the bore of the bushing, one end of the lubrication groove being communicated through a low pressure chamber defined in the inner end face of the bushing with a portion of a suction port located adjacent to the root or dedendum circle of the gear while the other end of the lubrication groove being communicated with the suction port through a hole extended through the bushing or casing or notch formed therein, whereby part of the liquid drawn through the suction port upon rotation of the intermeshing gears is forced into the pressure chamber because of the fact that the liquid drawn into each tooth space of the gear is imparted with the impact speed directed in the radial direction of the tooth space due to the difference between the speed with which the liquid is drawn into the gear pump and the rotational speed of the intermeshing gears, and the liquid is circulated from the low pressure chamber through the lubrication groove, thereby lubricating and cooling the shafts rotating in the bushes.

12 Claims, 10 Drawing Figures

GEAR PUMP WITH LOW PRESSURE SHAFT LUBRICATION

BACKGROUND OF THE INVENTION

The present invention relates to generally a gear pump and more particularly a hydraulic circuit means adapted to lubricate and cool the shafts of a pair of intermeshing gears with low pressure liquid drawn through a suction port of the gear pump.

The lubricating means for lubricating the shafts of a pair of intermeshing gears with low pressure liquid drawn through a suction port of a gear pump are disclosed, for instance, in U.S. Pat. No. 3,447,472, granted to J. E. Hodges et al, June 3, 1969, and in U.S. Pat. No. 3,490,382 granted to P. G. Joyner, Jan. 20, 1970. According to these inventions, there is provided gearing including at least two meshing rotors of toothed or lobed form whose shafts are mounted in bushes there requiring lubrication, wherein grooving is formed in the bore of each bush which is in communication with a side face of its respective motor in a zone located at a position where, as the rotor teeth or lobes successively pass it, the spaces between the meshing teeth or lobes are increasing in volume, the consequent suction created by the increase in volume inducing liquid to flow through the grooving in the bushes, thus to lubricate the shafts as they run in the bushes.

However, during almost all the time when the space between the meshing teeth or lobes is increased, the space is communicated with the suction port through the backlash between the intermeshing teeth or lobes so that the liquid is drawn from the suction port into the space. As a result, at low rotational speed at which the suction created by the increase in volume is weak, the liquid flowing into the inter-teeth space is decreased considerably in volume so that the shafts of the gears cannot be sufficiently lubricated with the resultant excessive wear and abrasion of the shafts and bushes and seizures in the worst case.

SUMMARY OF THE INVENTION

In view of the above, one of the objects of the present invention is to provide a gear pump with an improved lubricating means capable of, not only at low speeds but also at high speeds, circulating the liquid in relatively large quantity and with low pressure through axially extended grooves formed in the bores of the bushings so that the positive and reliable lubrication and cooling of the shafts may be attained.

A gear pump in accordance with the present invention includes at least a pair of intermeshing gears whose shafts are rotatably mounted in bushings. An axial groove is extended in the bore of each bushing from the inner end face thereof in contact with the gear to the outer end face remote from the gear. One end of the axial groove is communicated through a low pressure chamber, which is defined by a recess formed in the inner end face of the bushing, with a suction port at a position adjacent to the root or dedendum circle of the gear while the other end of the axial groove is communicated through a hole extended through or notch formed in the bushing or casing of the gear pump. Upon rotation of the intermeshing gears, the liquid drawn into each tooth space of each gear is imparted with an inpact speed due to the difference between the speed with which the liquid is drawn through the suction port and the rotational speed of the intermeshing gears. The present invention utilizes this liquid flow with the impact speed in order to force part of the drawn liquid into the low pressure chamber of each bushing. Therefore even when the intermeshing ears are rotated at low speeds, the low pressure liquid is positively and sufficiently forced into each low pressure chamber so as to be circulated through the axial groove of each bushing and returned to the suction port through a passage hole or notch formed in each bushing or casing, whereby the shafts of the gears may be positively lubricated and cooled. Therefore the seizure can be prevented even at low speed.

Instead of the axial lubrication groove, a spiral groove may be formed in the bore of each bushing. According to one embodiment, one end of each axial or spiral groove is communicated with its corresponding low pressure chamber through an undercut or relief recess formed at the root of each shaft while the other end of the axial or spiral groove is communicated with the suction port through an axial passage hole extended throughout the bushing from the outer end face to the inner end face thereof. The bushings may be formed to have a D-shaped cross sectional configuration, and a pair of such bushings may be assembled together with their flat surfaces made into abutment with each other. Therefore a pair of mating axial grooves may be formed in the flat surfaces of the D-shaped bushings when they are fabricated by die-casting or the like so that when a pair of bushings are assembled in the manner described above, the pair of mating grooves may define the axially extended flow passage. This arrangement is advantageous in that the step for drilling an axialy extended passage hole may be eliminated.

Alternatively, one or inner end of the axial or spiral groove in the bore of each bushing is communicated with the suction port through the undercut or relief recess formed at the root of each shaft and a radial hole intercommunicating the bore and the suction port while the other or outer end is communicated with the low pressure chamber through an axial hole drilled throughout the bushing from the outer end face to the inner end face thereof. Whereas in the first arrangement described above, the liquid drawn into the pressure chamber is forced to change the direction of its flow so as to flow through the undercut or relief recess at the root of the shaft to the axial or spiral groove in the bore of the bushing, in this arrangement the liquid drawn into the pressure chamber flows straight through the axial passage toward the outer end face of the bushing and then is forced to change the direction of its flow so as to flow into the axial or spiral groove in the bore of the bushing. Therefore the low-pressure, impact flow may be more effectively trapped in the pressure chamber.

When the gear pump is operated at high pressure, the high pressure liquid tends to leak into the suction port from the discharge port through the undercuts or relief recesses at the roots of the shafts so that the pressure in the bore of each bushing rises, adversely affecting the circulation of the low-pressure lubricating liquid through the axial or spiral lubrication groove. The present invention may also overcome this problem. For this purpose, a circumferentially partly extended or annular groove is formed in the bore of each bushing and spaced apart from the inner end face thereof by a relatively small distance. One end of the circumferentially partly extended groove is made into communication with the low pressure chamber of each bushing or with the suction port through a radial hole drilled through the side wall of the bushing (while the other end is communicated with the axial or spiral lubrication groove.). The recess or low pressure chamber is preferably communicated with the suction port through the groove formed in the bore of each bushing. The satisfactory lubrication and cooling of the shafts may be ensured by this arrangement even when the gear pump is operated under high pressure.

The above and other objects, features and advantages of the present invention will become more apparent from the following description of some preferred embodiments thereof taken in conjunction with the accompanying drawings.

BRIEF DESCRIPTION OF THE DRAWINGS

In FIGS. 7 and 8, those parts similar to those of the first embodiment shown in FIGS. 1 through 6 are designated by reference numerals each consisting of the reference numeral of a similar part in the first embodiment plus 100, and in like manner in FIGS. 9 and 10 reference numerals each consisting of the reference numeral used to designate a part in the first embodiment plus 200 and 300, respectively, are used to designate those parts similar to those in the first embodiment.

DESCRIPTION OF THE PREFERRED EMBODIMENTS

First Embodiments, FIGS. 1 through 6

Figure 1:
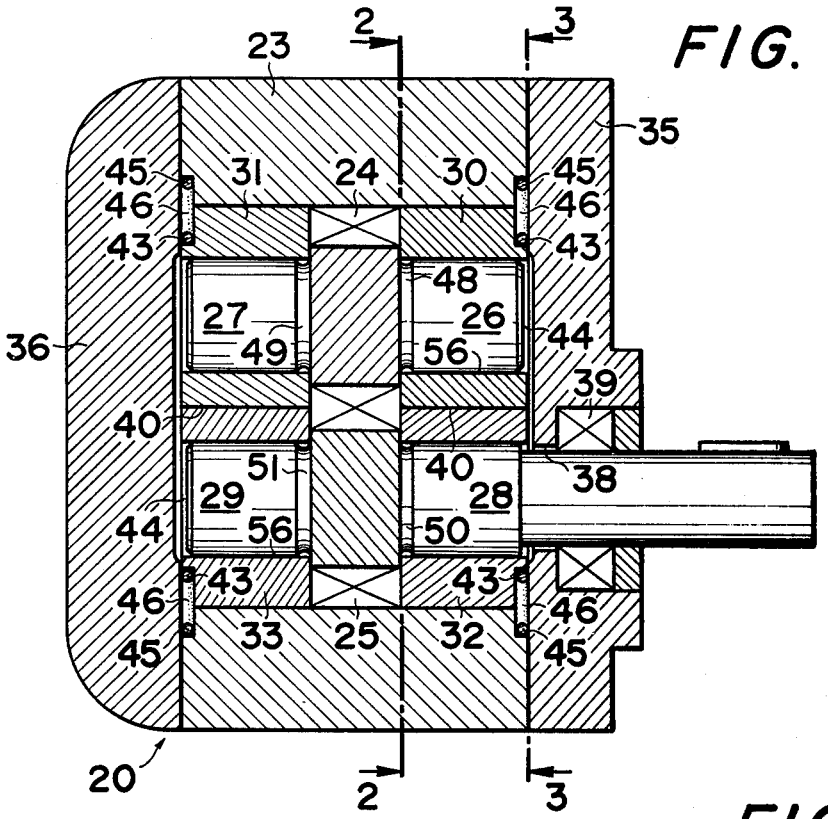
FIG. 1 is a sectional view of a first embodiment of a gear pump in accordance with the present invention.
Figure 2:
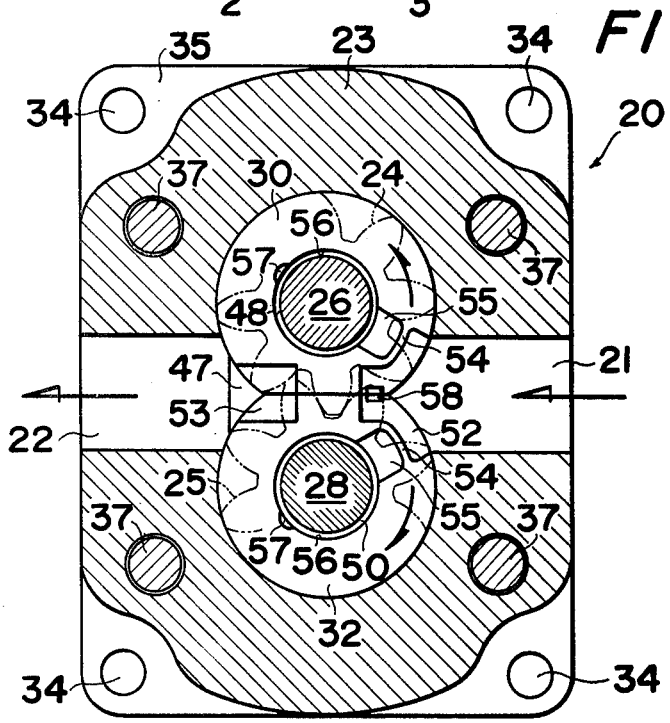
FIG. 2 is a sectional view taken along the line 2—2 of FIG. 1.
Figure 3:
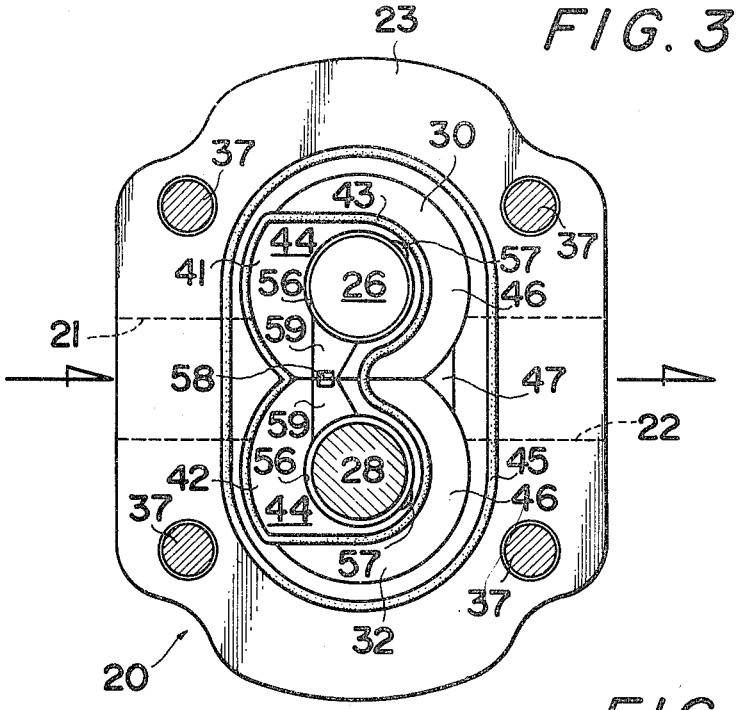
FIG. 3 is a sectional view thereof taken along the line 3—3 of FIG. 1.

First referring to FIGS. 1, 2 and 3, the first embodiment of a gear pump 20 in accordance with the present invention has a casing 23 having a pump cavity, a low pressure side or suction port 21 and a high pressure side or discharge port 22. A pair of gears 24 and 25 which are meshed with each other in the pump cavity are carried by shafts or trunnions 26 and 27 and 28 and 29, respectively. The right side shafts 26 and 28 are rotatably supported in a pair of bushings 30 and 32 while the left side shafts 27 and 29 are rotatably supported by a pair of bushings 31 and 33 to be described in more detail hereinafter. A mounting plate member 35 having mounting bolt holes 34 (See FIG. 2) and a cover plate member 36 are attached to the opposite open ends of the casing 23 and securely joined thereto with through bolts 37 (See FIGS. 2 and 3). The right side shaft 28 carrying the gear 25 is extended through a shaft hole 38 formed through the mounting plate member 35 for connection with an exterior prime mover (not shown), and an oil seal 39 is fitted into the enlarged diameter or countebored portion of the hole 38 for liquid-tightly sealing the right side shaft 28.

Figure 4:
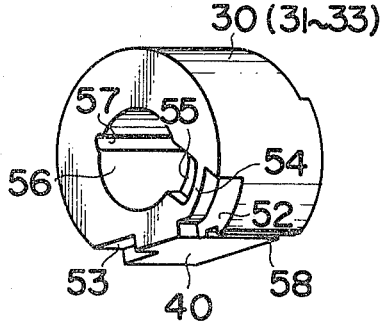
FIG. 4 is a perspective view of a bushing used for supporting the shaft of a gear of the gear pump shown in FIG. 1.
Figure 5:
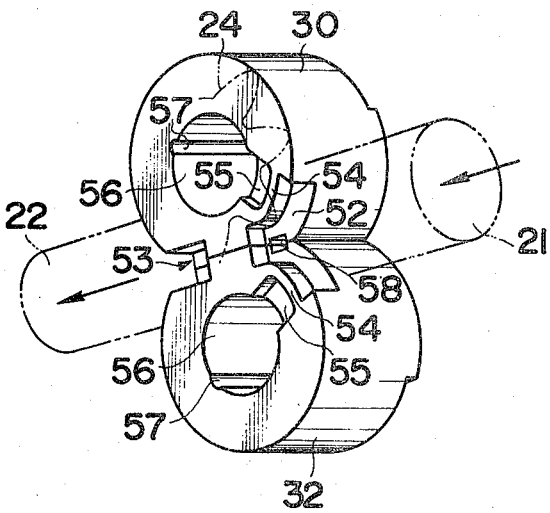
FIG. 5 is a perspective view of an assembly consisting of two bushings of the type shown in FIG. 4, a suction port, a discharge port and a gear being indicated by broken lines.

In the first embodiment, the bushings 30, 31, 32 and 33 are substantially similar in construction. As best shown in FIG. 4, each bushing 30 is in the form of a block having a D-shaped cross sectional configuration and a flat surface ridge 40 extended radially outwardly from the flat side surface of the bushing 30. In assembly, as best shown in FIG. 5, the pair of upper and lower bushings 30 and 32 are fitted into the pump cavity of the casing 23 with the flat surfaces of the ridges 40 made into abutment with each other. In like manner the right side pair of upper and lower bushings 31 and 33 are fitted into the pump cavity in symmetrical relation with the right-side pair of upper and lower bushings 30 and 32. Therefore only the right-side pair of bushings 30 and 32 will be described in detail hereinafter.

Referring back particularly to FIGS. 1 and 3, the upper and lower bushings 30 and 32 have raised portions or projections 41 and 42, respectively, extended axially outwardly from the outer end faces remote from the inner end faces of the bushings 30 and 32 made into contact with the end faces of the gears 24 and 25. As best shown in FIG. 3, a sealing ring 43 is fitted over the peripheral side surfaces of the raised portions 41 and 42. A low pressure side chamber or zone 44 is defined between the flat surface of the raised portion 41 or 42, one the one side, and the mounting plate member 35 as best shown in FIG. 1. As best shown in FIG. 3, the effective center of pressure of each low pressure chamber 44 is located eccentrically of the axis of the shaft 26 or 28 in order to counter the forces which are produced during the operation and act on the bushing 26 or 28 to tilt it.

A sealing ring 45 is interposed between the end face of the casing 23 and the mounting plate member 35 (or cover member 36) in the recess formed in the end face (as best shown in FIG. 1) outwardly of the sealing ring 43 confining the raised portions 41 and 42 of the bushings 30 and 32 so that a high pressure zone 46 is defined. This high pressure zone 46 is communicated with the discharge port 22 through a cutout portion or recess 47 formed in the casing 23.

The construction and arrangement of the bushings 30 through 33 described above ensure to attain the pressure balance in operation. In addition, the assembly consisting of the intermeshing gears 24 and 25 and bushings 30 through 33 is exerted with the pressure because of the construction and arrangement described above so that the positive sealing may be attained at the interfaces between the gears 24 and 25 on the one hand and the bushings 30 through 33 on the other hand.

As shown in FIG. 1, the shafts 26 through 29 of the gears 24 and 25 are provided with undercuts or relief recesses 48,49,50 and 51, respectively.

Next a low-pressure lubrication system on the side of the right-side pair of bushings 30 and 32 for lubricating and cooling the gears 24 and 25 and their shafts 26 through 29 will be described, but it will be understood that another low-pressure lubrication system is also provided on the side of the left-side pair of bushings 31 and 33 and is substantially similar in construction and mode of operation to the right-side lubrication system to be described below.

The inner end face of the bushing 30 or 32 in contact with the gear 24 or 25 is provided with recesses 52 and 53 as best shown in FIG. 4, and when the bushings 30 and 32 are assembled into the casing 23 together with the gears 24 and 25, these recesses 52 and 53 define spaces in direct communication with the suction and discharge ports 21 and 22, respectively, as best shown in FIG. 5.

As shown in FIGS. 4 and 5, the inner end face of each bushing 30 or 32 in contact with the gear 24 or 25 is formed with a radially outwardly partially extended recess 55. The outer end of the recess 55 is very close to the root or dedendum circle of the gear 24 or 25 and is spaced apart from the recess 52 by a wall 54 while the inner end is opened into an axial bore 56 of the bushing 30 or 32. This recess 55 defines a low pressure chamber.

The bore 56 of the bushing 30 or 32 is provided with an axial lubrication groove 57 which is semicircular in cross section in the first embodiment. This axial groove 57 is located at a position at which the shaft 26 or 28 of the gear 24 or 25 which rotates in the bushing 30 or 32 passes just beyond the region of high loading of the shaft 26 or 28. The inner end of the axial groove 57 is opened to the inner end face of the bushing 30 or 32 in contact with the gear 24 or 25 while the outer end is opened at the flat top surface of the raised portion or projection 41 or 42 at the outer end face of the bushing 30 or 32 remote from the gear 24 or 25.

When assembled, the low pressure chambers 55 which are opened into the bores 56 of the bushings 30 and 32 are defined as shown in FIGS. 2 and 3 and are communicated with the low pressure side zone or chamber 44 through the undercuts or relief recesses 48 and 50 of the shafts 26 and 28 and the axial lubrication grooves 57 in the bores 56 of the bushings 30 and 32.

Each of the bushings 30 and 32 is further provided with an axial groove 58 with the inner end opened into the recess 52 in communication with the suction port 21. In the first embodiment in which the flat surfaces 40 of the bushings 30 and 32 are made into abutment, the axial grooves 58 are formed in both or either of the flat surfaces 40 in such a way that when assembled, these axial grooves 58 form the passage 58 as shown in FIG. 5. This arrangement is advantageous in that the axial grooves which define the passage 58 may be formed simultaneously when the bushings 30 and 32 are formed by die-casting or the like so that the step for drilling an axial hole defining the passage 58 may be eliminated.

As shown in FIGS. 2 and 3, the inner end of the axial passage 58 is preferably opened into the recess 52 in opposed relation with the root or dedendum circle of each gear 24 or 25, but the inner end may be located radially outwardly of the root or dedendum circle. The outer end of the axial passage 58 is opened into recesses 59 formed in the flat surfaces of the raised portions or projections 41 and 42 remote from the gears 24 and 25. Each recess 59 is extended radially inwardly and terminated at the bore 56. Therefore the low pressure zone or chamber 44 which is in communication with the low pressure chamber 55 is communicated through the recesses 59 and the axial passage 58 with the recess 52 which in turn is communicated with the suction port 21. That is, a low pressure hydraulic circulation circuit is established between the recess 52 and the low pressure chambers 55.

Next the mode of operation will be described. Upon rotation of the shaft 28, the intermeshing gears 24 and 25 rotate in the casing 21 in the directions indicated by the arrows in FIG. 2, drawing the liquid from the suction port 21 and discharging it under pressure through the discharge port 22.

Figure 6:
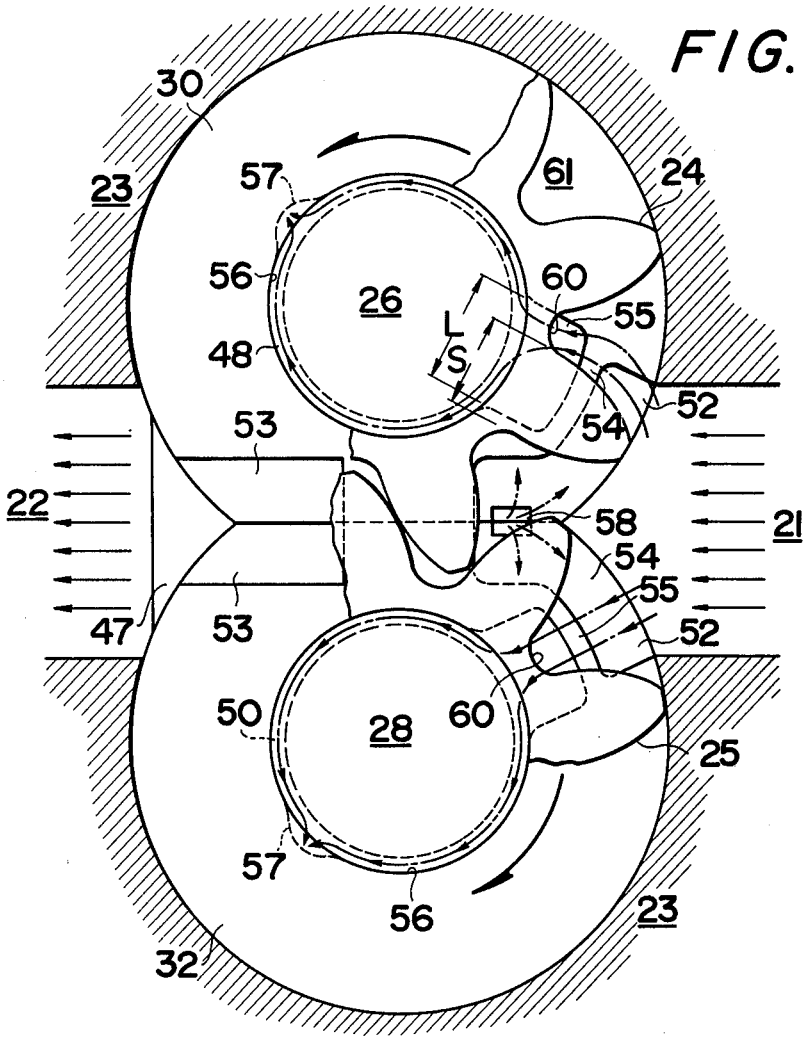
FIG. 6 is a view used for the explanation of the lubrication and cooling of the first embodiment.

Referring particularly to FIG. 6, upon rotation of the gears 24 and 25 in the directions indicated by the arrows, the low pressure liquid drawn through the suction port 21 flows into the tooth space 60. Because of the inertia of the liquid, the volume of the liquid flowing into the tooth space 60 is greater than the volume of the liquid in the tooth space 61 closed by the pump cavity wall of the casing 23; that is, the volume of the liquid being displaced toward the discharge port 22. The teeth of the gears 24 and 25 are displaced in a countercurrent relation with the liquid drawn through the suction port 21 so that the liquid violently impinges against the faces of the teeth in the space 60 and flows toward the axes of the gears 24 and 25 along the tooth curves. The experiments conducted by the inventors confirmed the fact that there exists a large flow in the vicinity of the bottom of the space 60 but there exists almost no flow in the vicinity of the tip of the tooth.

Because of the relative speed between the speed of the liquid flowing through the intake port 21 and the rotational speed of the gears 24 and 25, the liquid flowing into the space 60 becomes a parallel, impact flow flowing toward the axis of the gear 24 or 25 so that almost no liquid flows into the axial passage 58 located closer to the tip of the tooth. Therefore the liquid is forced into the low pressure chambers 55 located closer to the path of the roots of the teeth. The wall 54 between the low pressure chamber 55 and the recess 52 prevents the liquid from flowing from the low pressure chamber 55 toward the suction port 21 so that the liquid can be effectively drawn into the low pressure chamber 55.

There exists therefore the pressure difference between the low pressure chamber 55 and the opening or port of the axial passage 58 into the recess 52 so that the circulation of the liquid through the axial lubrication grooves 57 of the bushings 30 and 32 is induced. In this embodiment, the opening of the axial passage 58 into the recess 52 is located closer to the path of the tooth tips of the gears 24 and 25 so that the liquid that has been flown out of the axial passage 58 is forced to flow radially outwardly away from the port under the friction force acting between the liquid and the face of the tooth and the centrifugal force produced by the rotation of the gears 24 and 25. That is, the suction force is created in the vicinity of the port or opening. In the tooth space 60 spaced apart by one tooth from the opening of the passage 58, there exists the impact flow forcing the liquid into the low-pressure chamber 55. As a result, the pressure difference between the low pressure chamber 55 and the opening of the passage 58 is further increased so that the liquid circulating through the axial grooves 57 of the bushings 30 and 32 is increased in volume.

The liquid forced into the low pressure chamber 55 flows through the undercut 48 or 50 of the shaft 26 or 28 into the axial groove 57 formed in the bore 56 of the bushing 30 or 32 so that the sliding contact surfaces of the bore 56 and the shaft 26 or 28 may be lubricated and cooled. Thereafter the liquid is discharged from the axial groove 57 into the low pressure side chamber 44 and flows through the recess 59 and the axial passage 58 into the recess 52 to join the liquid flowing through the suction port 21.

In the low pressure zone of the gear pump 20, the low pressure liquid is circulated in large quantity in the manner described above so that the very effective lubrication and cooling may be attained and consequently the seizure of the shafts 26 and 28 can be positively prevented not only at low speeds but also at high speeds.

The left-side low-pressure lubrication and cooling system is substantially similar both in construction and mode of operation to the right side system described above.

Still referring to FIG. 6, the length *l* in the direction of rotation of the gear 24 or 25 of the low pressure chamber 55 is preferably greater than the tooth thickness S. Otherwise the desired effects cannot be attained because the tooth space 60 is intermittently opened to the low pressure chamber 55 and consequently the liquid flows intermittently through the axial groove 57. However, the continuous and safe operation of the gear pump may be permitted under normal operating conditions even when the lubricating and cooling liquid is made to flow intermittently.

Figure 7:
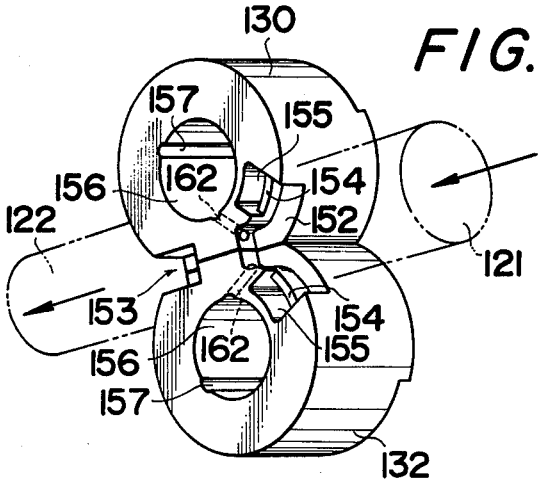
FIG. 7 is a perspective view of a bushing assembly used in a second embodiment of the present invention.
Figure 8:
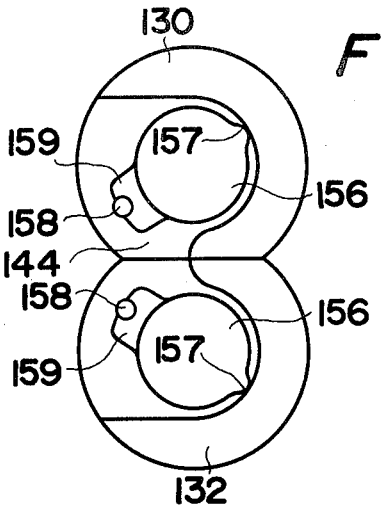
FIG. 8 is a rear view thereof.

Second Embodiment, FIGS. 7 and 8

The second embodiment of the present invention to be described below with reference to FIGS. 7 and 8 is substantially similar in construction to the first embodiment described above except that the direction of the liquid flow in the low-pressure lubrication and cooling system is opposite to that of the first embodiment.

In the first embodiment, the liquid drawn into the low pressure chamber 55 is forced to change the direction of its flow so as to flow into the undercut or relief recess 48 (49,50 and 51) toward the axial lubrication groove 57 so that some of the liquid is forced to return from the low pressure chamber 55 to the recess 52. This problem is overcome by the second embodiment. For this purpose, a low pressure chamber 155 of a bushing 130 or 132 is spaced apart from a bore 156 of the bushing 130 or 132 and is directly communicated with a recess 159 formed in the outer end face of the bushing 130 or 132 through a hole 158 drilled axially through the bushing 130 or 132, and a radial hole 162 is drilled through the bushing 130 or 132 so as to intercommunicate between the bore 156 and a recess 152 which is in communication with the suction port 21. As shown in FIG. 8, the recesses 159 at the outer end faces of the bushings 130 and 132 are not required to be formed such that they may be hydraulically communicated with each other when the bushings 130 and 132 are assembled together.

In the low pressure lubrication system of the second embodiment, the liquid forced into the low pressure chamber 155 flows through the axial hole 158, the recess 159 and the low pressure side chamber 144 into the axial groove 157, lubricating the sliding contact surfaces of the bore 156 and the shaft 26 (27,28 and 29). Thereafter the liquid flows through the undercut or relief recess 48 (49,50 and 51) and the radial hole 162 into the recess 152.

In the second embodiment, therefore, the liquid drawn into the low pressure chamber 155 is not forced to change the direction of its flow. The liquid flows straight through the axial hole 158 into the recess 159 at the outer end face of the bushing 130 or 132, and then is forced to change the direction of its flow in the recess 159 and the low pressure side chamber 144 so as to flow into the axial groove 157. As a result, the impact liquid flow flowing through the tooth space 60 can be more positively trapped in the low pressure recess 155 as compared with the first embodiment. In the second embodiment, the top face of the side wall 154 between the recess 152 and the low pressure chamber 155 is not required to be coplanar with the inner end face of the bushing 130 or 132 as best shown in FIG. 7.

In the first and second embodiments, when the gear pump is operated at high pressure, the high pressure liquid in the discharge port 22 tends to leak through the undercuts or relief recesses 48 to 50 of the shafts 26 to 29 into the suction port 21 so that the pressure in the undercuts or relief recesses 48 to 50 rises, adversely affecting the circulation of the low pressure lubricating liquid.

Figure 9:
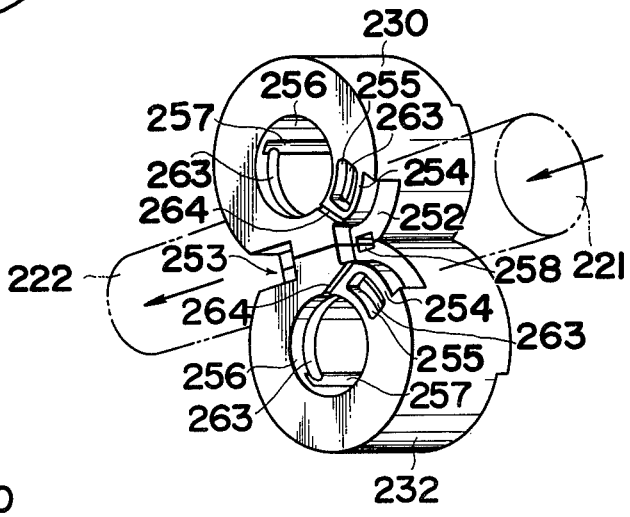
FIG. 9 is a perspective view of a bushing assembly used in a third embodiment of the present invention which is a modification of the first embodiment.
Figure 10:
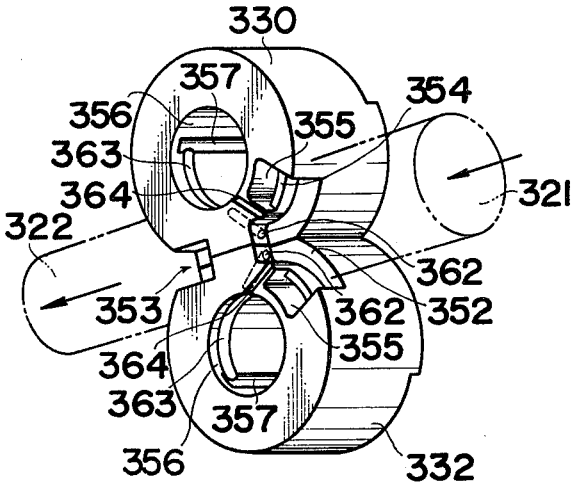
FIG. 10 is a perspective view of a bushing assembly used in a fourth embodiment of the present invention which is a modification of the second embodiment shown in FIGS. 7 and 8.

This problem can be solved by the arrangements shown in FIGS. 9 and 10, respectively. The arrangement shown in FIG. 9 is a modification of the first embodiment while the arrangement shown in FIG. 10 is a modification of the second embodiment.

Referring to FIGS. 9 and 10, a circumferentially directed groove 263 or 363 is formed in the wall of the bore 256 or 356 of a bushing 230 (232) or 330 (332) and spaced apart by a suitable distance from the inner end face of the bushing 230 (232) or 330 (332). One end of the circumferentially directed groove 263 or 363 is terminated at the axial lubrication groove 257 or 357. In both FIGS. 9 and 10, the groove 263 or 363 is shown as being partly circumferentially extended, but it will be understood that the groove 263 or 363 may be annular. Instead of forming the circumferentially directed groove 263 or 363 in the wall of the bore 256 or 356, a suitable bush may be inserted into the bore 256 or 356 so as to define the circumferentially extended groove 263 or 363. A radial groove 264 or 364 is formed in the inner end face of the bushing 230 (232) or 330 (332) to intercommunicate between the bore 256 or 356 and the recess 252 or 352. In the modification shown in FIG. 9, the low pressure chamber 255 is spaced apart from the bore 256, and the other end or port of the circumferentially extended groove 263 is opened at the bottom of the low pressure chamber 255. In the modification shown in FIG. 10, a radial hole 362 is drilled through the bushing 330 or 332 so as to intercommunicate between the bore 356 and the recess 352.

In the modification or third embodiment shown in FIG. 9, the liquid flows from the low pressure chamber 255 through the circumferential groove 263 into the axial groove 257. In the modification or fourth embodiment shown in FIG. 10, the liquid from the axial groove 357 flows through the circumferential groove 363 and the radial hole 362 into the recess 352. Therefore both the low pressure lubrication system shown in FIGS. 9 and 10 do not include the undercuts or relief recesses 48 to 51 of the shafts 26 to 29 so that the pressure rise in these undercuts 48 to 51 will never adversely affect the circulation of the liquid through the low-pressure lubrication systems. Therefore even when the gear pump is operated at high pressure, the satisfactory lubrication and cooling of the sliding contact surfaces of the shafts and the bushings can be attained.

So far the bushings have been described as being D-shaped in cross section and as being made to abut with the adjacent one, but it will be understood that they may be in any suitable form and that instead of the two-piece construction, a pair of bushings may be formed as a unitary construction. Furthermore, one of a pair of bushings may be formed integral with the casing.

The present invention is not limited to the gear pump of the type described above, but may be applied to any other types of gear pumps. For instance, in a gear pump of the type having axially movable or stationary side plates in contact with the side faces of the gears, a low pressure lubrication circuit including a low pressure chamber may be provided for each side plate.

Moreover it will be understood that the present invention is not limited to the provision of the undercuts or relief recesses at the roots of the shafts of the gears. For instance, the inner side edge of the bore of the bushing may be beveled. And any other suitable means may be employed to define an annular passage around the root of each shaft.

What is claimed is:

1. A method of lubricating the trunnions and bushings of a gear pump, comprising the steps of rotating the gears of the gear pump so as to draw liquid into the same through a low-pressure port of the pump, the incoming liquid impinging the bottom of the tooth spaces between the teeth of the gears and changing a pressurized impact flow due to the difference between the flow speed of the incoming liquid and the rotational speed of said gears;

utilizing the kinetic energy of the pressurized liquid so as to channel some of said pressurized liquid into a low-pressure chamber formed in the inner end face of a respective bushing in contact with an axial side face of a respective gear and separated by a wall from a radically outer recess formed in said end face in communication with said low-pressure port and diverting said trapped pressurized liquid into a lubricating groove which distributes the liquid to the respective trunnions and bushings; and thereafter returning the liquid to said low-pressure port, so that forced lubrication is assured even when said gears rotate at low speed.

2. In a gear pump, a combination comprising a housing having a pump chamber, a low-pressure port and a high-pressure port both communicating with said pump chamber;

at least one pair of meshing gears mounted for rotation in said pump chamber and each having two axially spaced trunnions;

a plurality of bushings each having an axial bore mounting one of said trunnions for rotation, a lubrication groove in a surface bounding said bore, and an end face in contact with an axial face of a respective gear;

motor means for rotating said gears so that liquid which is drawn through said low-pressure port into the tooth spaces of the rotating gears impinges against the bottoms of said tooth spaces and becomes pressurized due to the difference between the flow speed of the incoming liquid and the rotational speed of said gears and is thereafter expelled through said high-pressure port;

a first recess formed in said end face in contact with an axial face of a respective gear and separated by a wall from a radically outer second recess in said end face in communication with said low-pressure port, said first recess defining a low-pressure chamber for trapping therein some of said pressurized liquid; and means for channeling said liquid trapped in said first recess in said tooth spaces into said lubrication groove so that forced lubrication is assured even at low rotational speed of said gears.

3. A combination as defined in claim 2, wherein said channeling means comprises said low-pressure chamber formed in said end face of the respective bushing and having an open side bounded by said axial face of the associated gear, and a circumferentially extending groove formed in the bore of the bushing and communicating said low-pressure chamber with said lubrication groove.

4. A combination as defined in claim 2, wherein said first recess which constitutes said low-pressure chamber communicates with said low-pressure port and is positioned in opposed relationship with the bottoms of said tooth spaces of said gears passing said low-pressure port wherein the incoming liquid becomes pressurized due to changing of the liquid flow into an impact flow which enters radially by its own kinetic energy into said low-pressure chamber; and wherein said channeling means further comprise return-flow means communicating the respective lubrication groove with said low-pressure port.

5. A combination as defined in claim 4, wherein said return-flow means comprises an outlet end of the respective lubrication groove.

6. A combination as defined in claim 4, wherein said return-flow means comprises a return port communicating the respective lubrication groove with said low-ressure port.

7. A combination as defined in claim 4, wherein said return-flow means are positioned adjacent a path travelled by the tips of the teeth of said gears.

8. A combination as defined in claim 4, wherein said return-flow means comprises a clearance between the respective trunnion and bushing and a radial hole formed in a circumferential wall of the bushing.

9. A combination as defined in claim 4, wherein said return-flow means comprises a circumferentially extending groove formed in the bore of the respective bushing, and a radial hole formed in a circumferential wall of the bushing and communicating said circumferentially extending groove with said low-pressure port.

10. A combination as defined in claim 4, wherein said low-pressure chamber has a length in the direction of rotation of said gears which is greater than the thickness of the teeth of said gears in the circumferential direction of said gears.

11. A combination as defined in claim 4, wherein each low-pressure chamber and the corresponding lubrication groove are communicated with one another by a clearance between the respective trunnion and bushing, and wherein said return-flow means comprise a chamber defined at an outer end face of the respective bushing and a passage hole communicating the respective lubrication groove with said chamber.

12. A combination as defined in claim 11, wherein said bushings which are located at the same axial end of said gears have abutment surfaces which engage one another, said passage hole being defined by a pair of mating grooves formed in the respective engaging abutment surfaces.

* * * * *